United States Patent [19]

Watanabe

[11] Patent Number: 4,733,266

[45] Date of Patent: Mar. 22, 1988

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 792,312

[22] Filed: Oct. 28, 1985

[30] Foreign Application Priority Data

Oct. 29, 1984 [JP] Japan ..... 59-227419
Oct. 29, 1984 [JP] Japan ..... 59-227421
Oct. 31, 1984 [JP] Japan ..... 59-227904

[51] Int. Cl.[4] ..... G03G 15/00

[52] U.S. Cl. ..... 355/3 R; 355/7; 355/8; 355/14 R; 355/55

[58] Field of Search ..... 355/3 R, 8, 14 R, 14 SH, 355/55, 75, 7, 14 E

[56] References Cited

U.S. PATENT DOCUMENTS 4,080,062 3/1978 Torigai et al. ..... 355/8
4,256,400 3/1981 Komori et al. ..... 355/14 SH
4,501,490 2/1985 Miyamoto et al. ..... 355/55
4,582,417 4/1986 Yagasaki et al. ..... 355/7
4,595,273 6/1986 Watanabe et al. ..... 355/8 X
4,611,908 9/1986 Buch ..... 355/55
4,614,422 9/1986 Sobotta et al. ..... 355/55 X
4,615,611 10/1986 Yoshiura ..... 355/55 X
4,618,244 10/1986 Watanabe ..... 355/14 SH
4,690,543 9/1987 Watanabe ..... 355/14 R X

*Primary Examiner*—A. T. Grimley
*Assistant Examiner*—Jane K. Lau
*Attorney, Agent, or Firm*—Cushman, Darby & Cushman

[57] ABSTRACT

A carriage acting as a light shielding plate is moved along a table in accordance with a desired copying magnification and binding margin which is displayed between a stationary scale and a movable scale provided on the carriage. A display is provided on the carriage for selectively displaying the preset copying magnification and the desired binding margin in response to a position of the carriage.

15 Claims, 29 Drawing Figures

IMAGE FORMING APPARATUS

BACKGROUND OF THE INVENTION

The present invention relates to an image forming apparatus which displays an image formation range when an image is formed.

Recently, an image forming apparatus, e.g., an electronic copying machine having functions for copying an image of an original on a paper sheet without changing its size, enlarging or reducing copy, or forming an image with a noncopied section to be utilized as a binding margin or the like has been developed. However, in such a copying machine, a preset copying magnification or an image forming range is only quantitatively displayed on a control panel, and an operator cannot grasp the relationship of the copy to be made relative to the original.

SUMMARY OF THE INVENTION

It is an object of the present invention to provide an image forming apparatus, of good operability, which can directly and quantitatively display the copying range and the non-copying range on an image of the original.

According to the present invention, there is provided an image forming apparatus which displays an image forming range and an image nonforming range by using first and second carriages and an image of an original, as an optical scanning means.

BRIEF DESCRIPTION OF THE DRAWINGS

FIGS. 1 to 21 are views showing an embodiment of an image forming apparatus in accordance with the present invention, in which:

FIG. 1 is a perspective view showing the outer structure;

FIG. 2 is a side sectional view;

FIG. 3 is a plan view of a control panel;

FIG. 4 is a perspective view of an arrangement of a drive unit;

FIG. 5 is a perspective view of the drive mechanism of the optical system;

FIG. 6 is a perspective view of the drive mechanism of indexes;

FIG. 7 is a block diagram of the entire control circuit;

FIG. 8 is a block diagram of a main processor group;

FIG. 9 is a block diagram of a first sub-processor group;

FIG. 10 is a block diagram of a second sub-processor group;

FIG. 11 is a block diagram of a control circuit of a pulse motor;

FIG. 12 is a graph explaining the speed control operation of the pulse motor;

FIGS. 14 and 15 are plan views of different states of an original table;

FIG. 16 is a perspective view of the main part and shows a displayed state of a binding margin;

FIG. 17 is a perspective view of an example of a binding margin;

FIGS. 18 to 20 are plan views of displayed states of a display unit; and FIG. 21 is a perspective view of another example of the display unit.

FIGS. 22 to 27 are views of another embodiment of an image forming apparatus in accordance with the present invention, in which:

FIG. 22 is a plan view;

FIG. 23 is a perspective view of an arrangement of the optical system;

FIGS. 24 to 26 are plan views illustrating the operation of the arrangement shown in FIGS. 22 and 23; and FIG. 27 is a perspective view of an example of a binding margin.

DETAILED DESCRIPTION OF THE PREFERRED EMBODIMENT

An image forming apparatus according to an embodiment of the present invention will be described with reference to the accompanying drawings.

Figure 1:
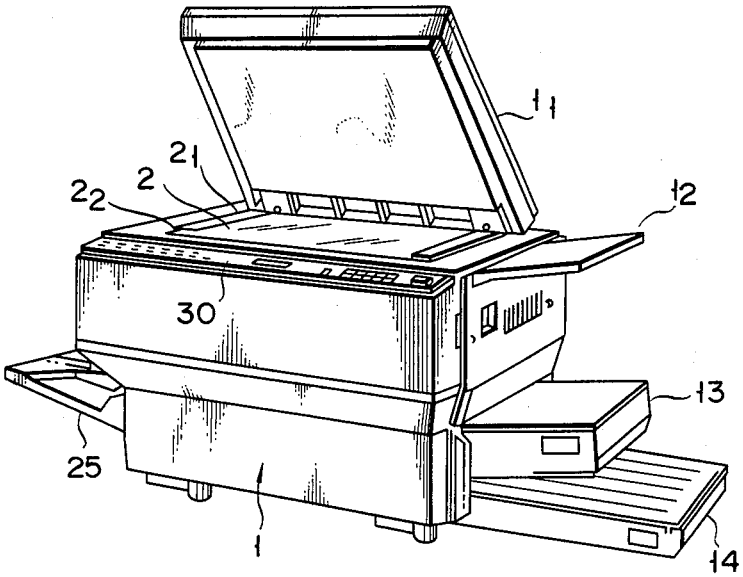
Figure 2:
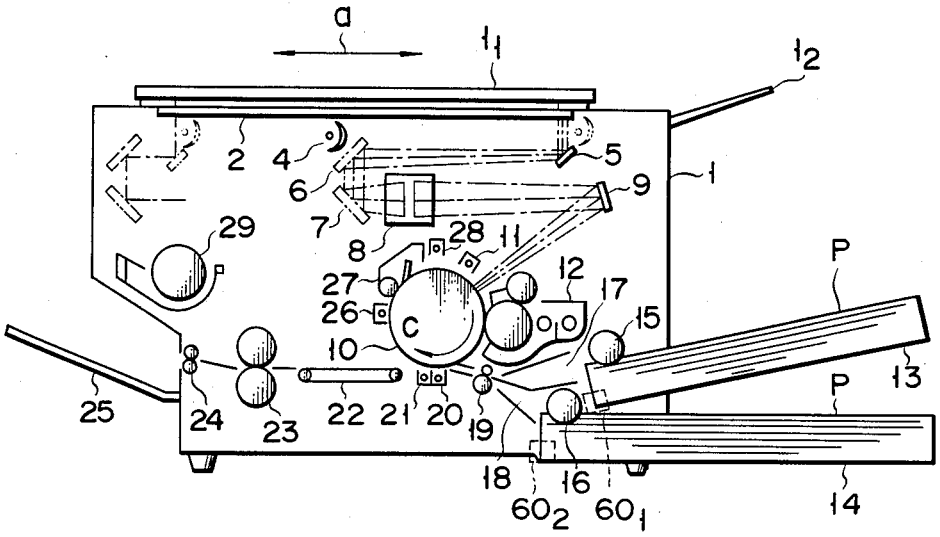

FIGS. 1 and 2 are schematics of an image forming apparatus such as a copying machine. An original table (a transparent glass) 2 for supporting an original is fixed on the upper surface of a housing 1. A stationary scale $2_1$ is disposed in the table 2 and serves as a fixed reference. An openable original cover $1_1$ and a work table $1_2$ are arranged near the table 2. The original placed on the table 2 can be scanned while an optical system consisting of an exposure lamp 4 and mirrors 5, 6 and 7 reciprocates back and forth in the direction indicated by arrow a. In this case, the mirrors 6 and 7 are moved at a speed half that of the mirror 5 so as to ensure the proper optical length. Light reflected by the original upon scanning by the optical system, that is, light reflected by the original upon illumination from the lamp 4, is reflected by the mirrors 5, 6 and 7 and passes through a magnification change lens block 8. The light is then reflected by the mirror 9, and the reflected light is directed to a photosensitive drum 10.

The image of the original is focused on the surface of the drum 10. The drum 10 is rotated in the direction indicated by arrow c and is charged by a charger 11. Thereafter, the image is exposed through a slit, so that a latent image is formed on the surface of the drum 10. The latent image is rendered visible by the developing unit 12 upon application of toner to the latent image.

Sheets (transfer media) P are fed from a selected upper or lower paper cassette 13 or 14 by a pickup roller 15 or 16, one by one. The fed sheet is guided to an aligning roller pair 19 through a paper guide path 17 or 18. The sheet is then fed by the rollers 19 to the transfer section. The cassettes 13 and 14 are detachably attached to a portion of the lower end of the right side of the housing 1. An operator selects one of the cassettes at a control panel to be described later. The sizes of the cassettes 13 and 14 are detected by cassette size sensor switches $60_1$ and $60_2$. The switches $60_1$ and $60_2$ comprise a plurality of microswitches which are turned on/off upon attachment/detachment of the corresponding cassettes.

The sheet P fed to the transfer section is brought into close contact with the surface of the drum 10, and a toner image is transferred by the charger 20 from the surface of the drum 10 to the sheet P. The image-transfer sheet P is electrostatically separated from the drum 10 by a separating charger 21, and the sheet is fed to the fixing roller 23 which serves as a fixing unit arranged at the terminal end of the conveyor belt 22. The transfer image is fixed while the sheet passes by the fixing roller 23. The sheet P is finally discharged by a discharge roller pair 24 outside the housing 1 and is placed on the tray 25. After the transfer operation, the drum 10 is discharged by the discharger 26, and residual toner left on its surface is removed by a cleaner 27. The surface of the drum 10 is finally quenched by a lamp 28 so that the drum 10 is restored to is original state. Reference numeral 29 denotes a cooling fan for preventing a rise in temperature.

Figure 3:
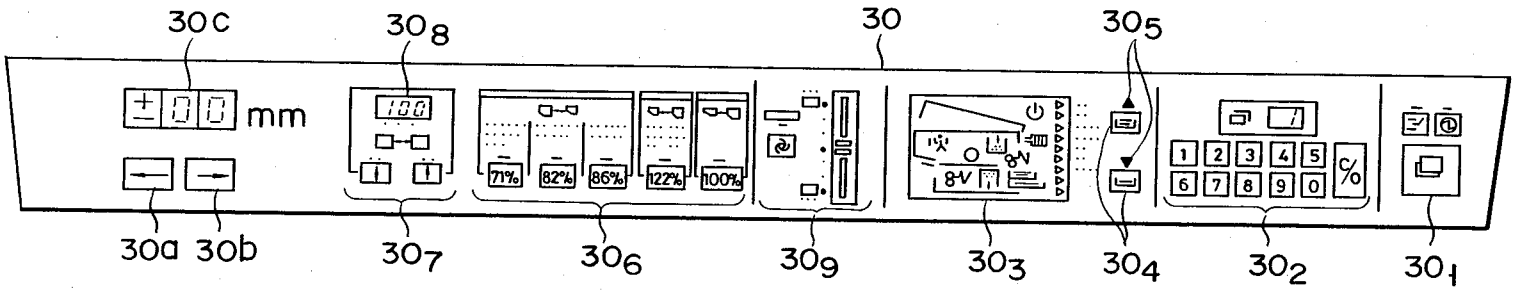

FIG. 3 shows a control panel 30 arranged on the housing 1. Reference numeral $30_1$ denotes a copying key for designating start of copying; $30_2$, a ten-key pad for entering a copying number; $30_3$, a display for displaying operating states of the respective components (paper jam and the like); $30_4$, a cassette selection key for selecting one of the cassettes 13 and 14; $30_5$, a cassette display for displaying the selected cassette; $30_6$, a magnification setting key for setting an enlargement or reduction coefficient of an image at a predetermined rate; $30_7$, a zoom key for setting an enlargement or reduction coefficient of the image in a nonstep manner; $30_8$, a display for displaying the set enlargement or reduction coefficient; $30_9$, a density setting section for setting the copying density; **30*a* and 30*b*, operation keys for setting the width of an image nonforming range or binding margin (to be described later) of an original; and 30*c***, a display for displaying the preset width of the binding margin.

Figure 4:
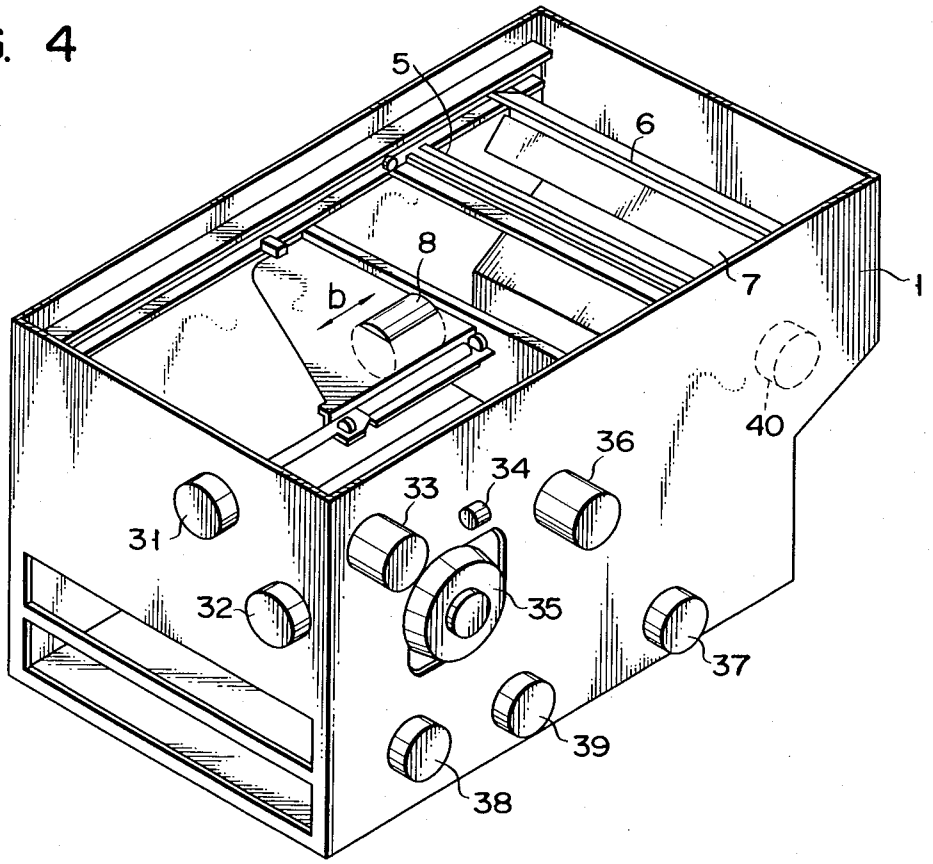

FIG. 4 shows the arrangement of drive sources of the respective drive mechanisms in the copying machine arranged as described above. The drive sources are given as follows: reference numeral 31 denotes a lens motor for shifting the position of the block 8 so as to form an enlarged or reduced image; 32, a mirror motor for changing the optical length such that it corresponds to the distance between the mirror 5 and the mirrors 6 and 7; 33, an original scanning mirror for moving the mirrors 5, 6 and 7 so as to scan the original; 34, a shutter motor for moving a shutter (not shown) to adjust the charge width of the charger 11 for the drum 10 in the magnification change mode; 35, a developing motor for driving the developing roller 12; 36, a drum motor for driving the drum 10; 37, a fixing motor for driving the path of the conveyor belt 22 and the pair of fixing roller 23 and discharge roller 24; 38, a paper feed motor for driving the rollers 15 and 16; 39, a paper feed motor for driving the roller pair 19; and 40, a fan motor for driving the fan 29.

Figure 5:
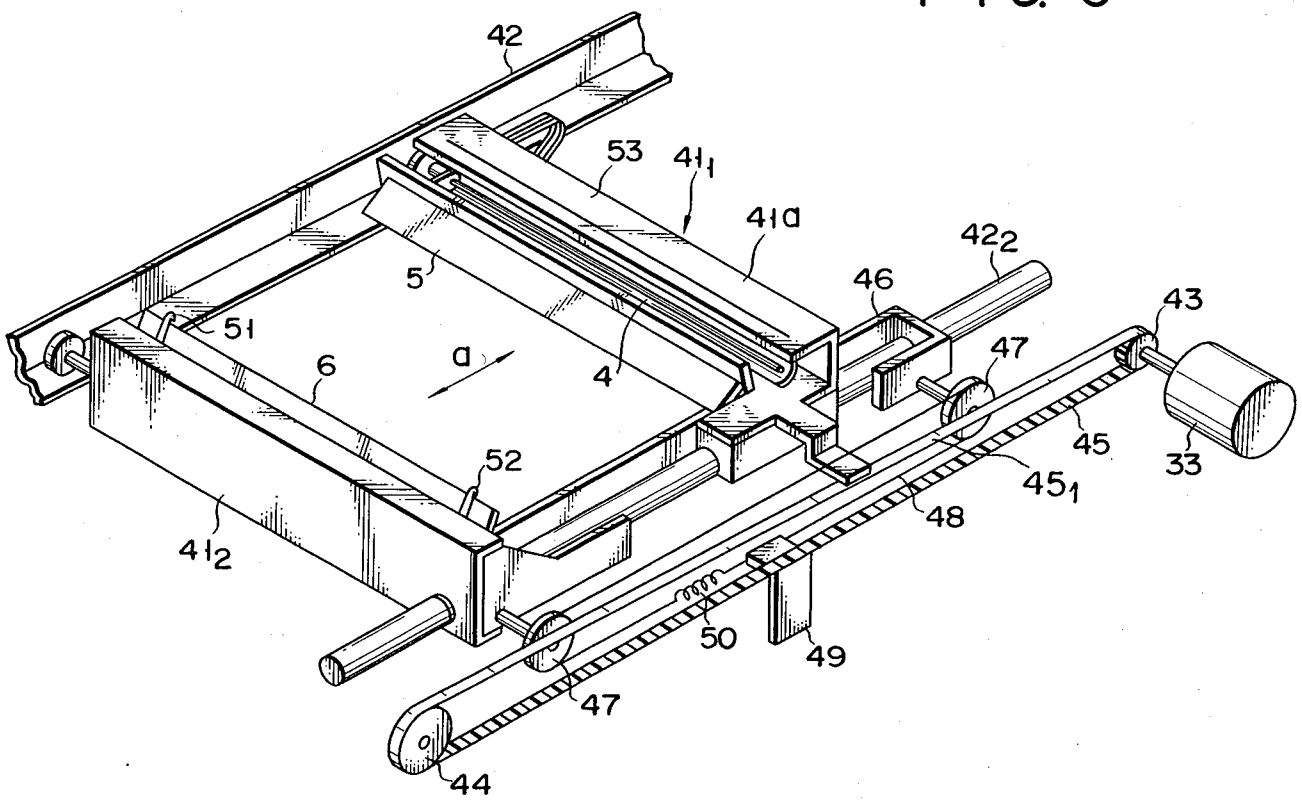

FIG. 5 shows the optical system drive mechanism. The mirror 5 and the lamp 4 are supported on the first carriage $41_1$, and the mirrors 6 and 7 are supported on the second carriage $41_2$. The carriages $41_1$ and $41_2$ are guided along guide rails $42_1$ and $42_2$ and are moved parallel to each other in the direction indicated by arrow a. The 4-phase motor 33 drives a pulley 43. An endless belt 45 is looped between the pulley 43 and an idler pulley 44. One end of the mirrors 5 supporting carriage $41_1$ is fixed midway along the belt 45. Two pulleys 47 are rotatably provided in a guide portion 46 in the carriage $41_2$ for supporting the mirrors 6 and 7 and are spaced apart along the axial direction of the rail $42_2$. A wire 48 is looped between the pulleys 47. One end of the wire 48 is fixed to a stationary portion 49, and the other end thereof is fixed to the portion 49 through a coil spring 50. One end of the carriage $41_1$ is fixed midway along the wire 48. When the motor 33 is rotated, the belt 45 is rotated accordingly and the carriage $41_1$ and then the carriage $41_2$ are moved. In this case, the pulleys 47 serve as movable rollers so that the carriage $41_2$ is moved at a speed half that of the carriage $41_1$, but in the same direction. The direction of the carriages $41_1$ and $41_2$ movement is controlled by changing the rotational direction of the motor 33.

A possible copying range corresponding to the specified sheet size is displayed in the table 2. Assume that a paper size designated by the key $30_4$ is given as (Px,Py) and a copying magnification coefficient designated by the keys $30_6$ and $30_7$ is given as K. A possible copying range (x,y) is defined as "x=Px/K" and "y=Py/K". An x-axis length of the range (x,y) is displayed as a mutual distance between indexes 51 and 52 arranged on the lower surface of the table 2, and a y-axis length is displayed on a scale 53 arranged on the upper surface of the carriage $41_1$.

Figure 6:
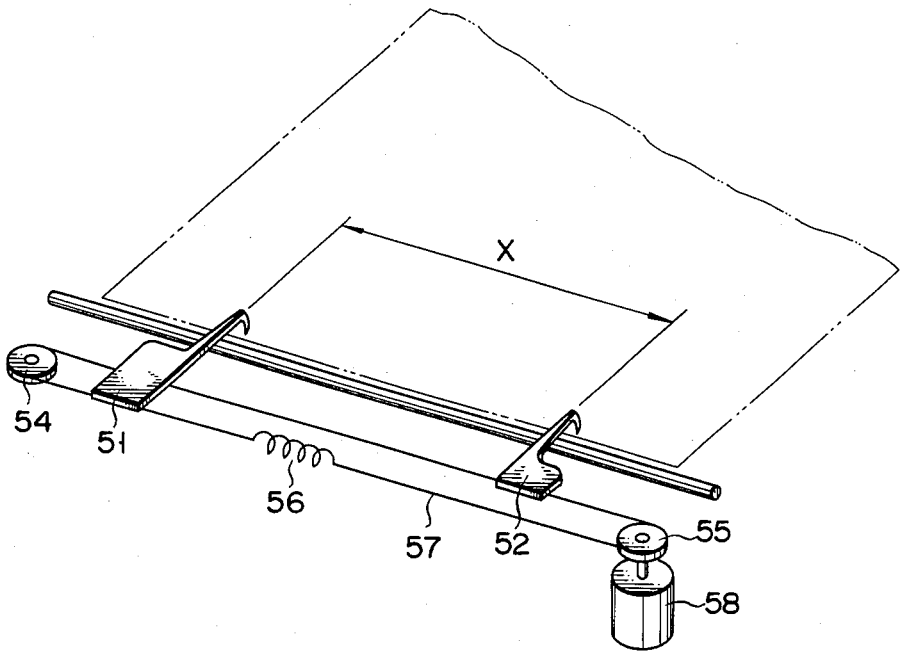

The indexes 51 and 52 are arranged on a wire 57 looped around pulleys 54 and 55 through a spring 56, as shown in FIG. 6. The pulley 55 is rotated by the motor 58. When the motor 58 is driven to achieve copying in the x direction, the distance between the indexes 51 and 52 can be changed.

The carriage $41_1$ is driven by the motor 33 to a predetermined position (i.e., a home position based on each magnification coefficient) in accordance with the paper size and the magnification coefficient. When the key $30_1$ is depressed, the carriage $41_1$ is moved toward the carriage $41_2$. Thereafter, the lamp 4 is turned on and the carriage $41_1$ is moved away from the carriage $41_2$. When original scanning is completed, the lamp 4 is turned off, and the carriage $41_1$ returns to the home position.

Figure 7:
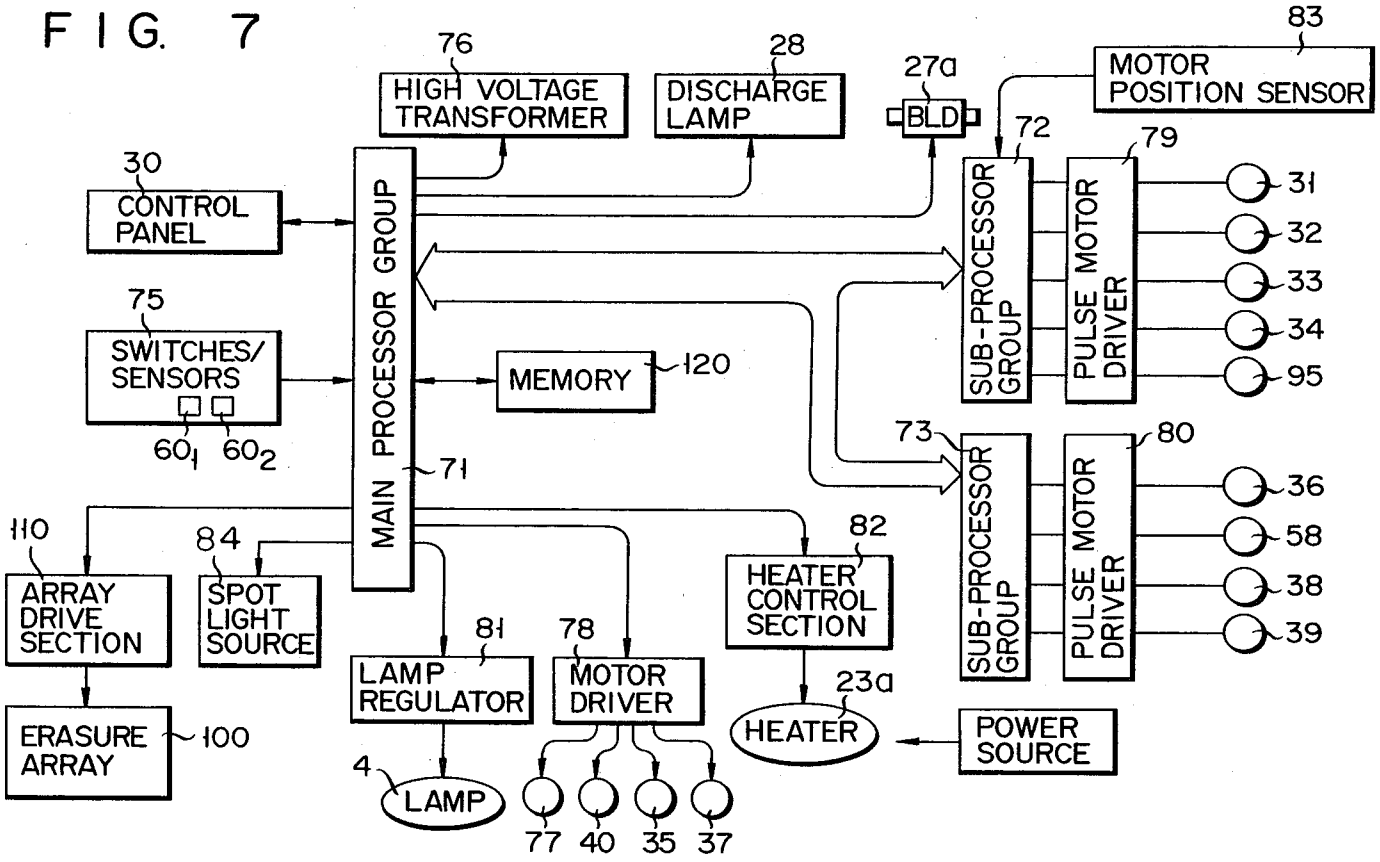

FIG. 7 shows the overall arrangement of a control circuit. A main processor group 71 receives output from the panel 30 and the switches and sensors (switches/sensors 75 such as the switches $60_1$ and $60_2$), and controls a high voltage transformer 76 for driving the various chargers described above: the discarge lamp 28, a blade solenoid **27*a* of the cleaner 27, a heater 23*a* of the pair 23, the lamp 4 and the motors 31 to 40 and 58, thereby performing copying. At the same time, the group 71 also controls a spotlight source 84, a pulse motor 95, a memory 120, an erasure array 100 and an array drive mechanism 110 so as to erase the unwanted portion of the original. The source 84, the motor 95, the array 100, the array drive mechanism 110 and the memory 120** will be described later.

The motors 35, 37 and 40, among the motors 31 to 40 and 58, and a toner motor 77 for supplying toner to the unit 12 are controlled by the group 71 through a motor driver 78. The motors 31 to 34 and 95 are controlled by a first sub-processor group 72 through a pulse motor driver 79. The motors 36, 38, 39 and 58 are controlled by a second sub-processor group 73 through a pulse motor driver 80. The lamp 4 is controlled by the group 71 through a lamp regulator 81, and the heater **23*a* is controlled by the group 71 through a heater control section 82. The group 71 supplies to the groups 72 and 73 control signals for designating driving/interruption of the motors. The groups 72 and 73 supply to the group 71 status signals representing the driving/interruption states of the motors. The group 71 receives position data from a position sensor 83. The position data represent the initial positions of the motors 31 to 34**.

Figure 8:
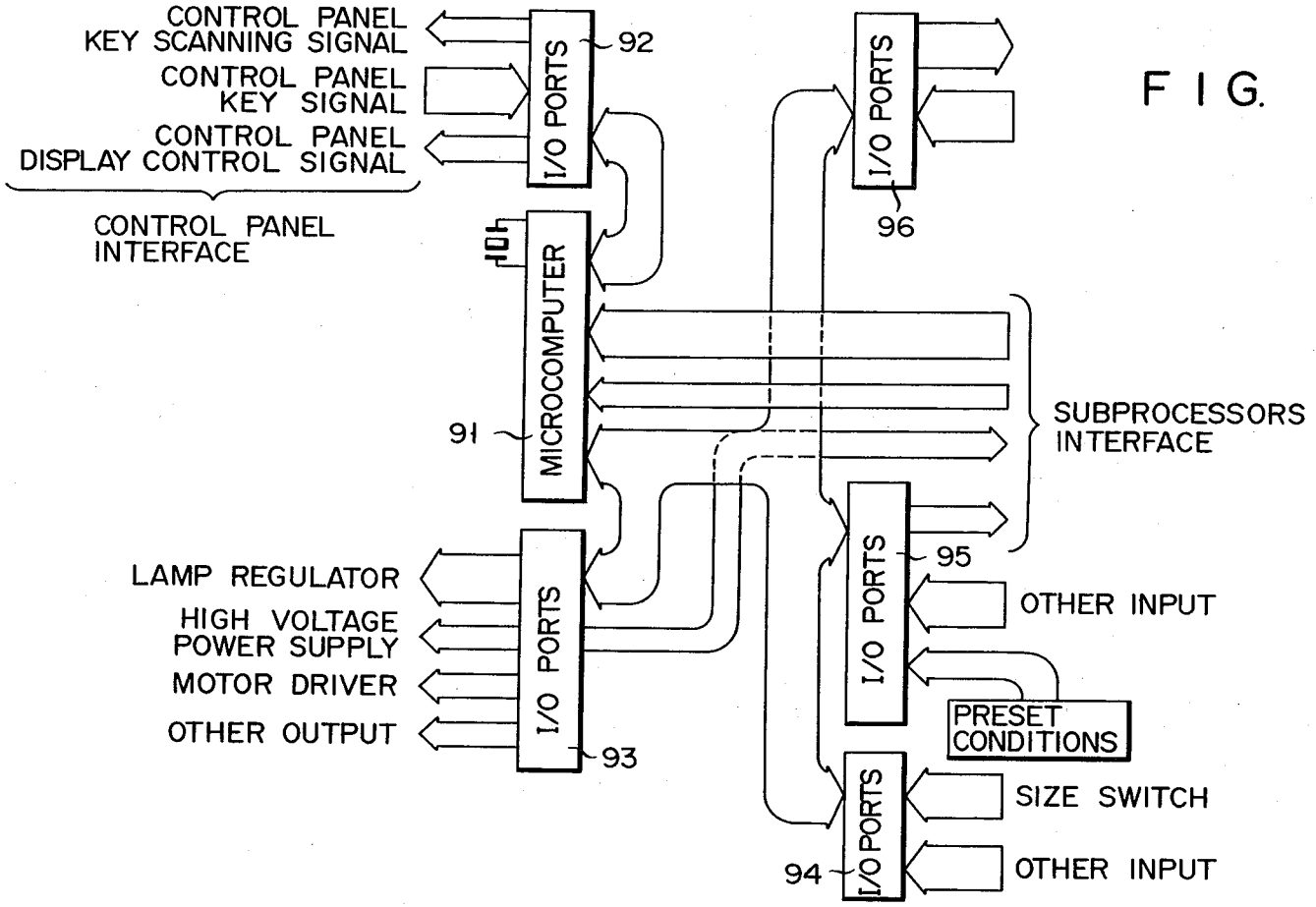

FIG. 8 shows an arrangement of the group 71. A one-chip microcomputer 91 detects key input at the control panel (not shown) and performs various display control operations through an I/O port 92. The microcomputer 91 can be expanded through I/O ports 93 to 96. The port 93 is connected to the transformer 76, the driver 78, the regulator 81 and other outputs. The port 94 is connected to the size switch for detecting paper size and other input. The port 95 is connected to the copying condition preset switch and other input. The port 96 serves as an optional port.

Figure 9:
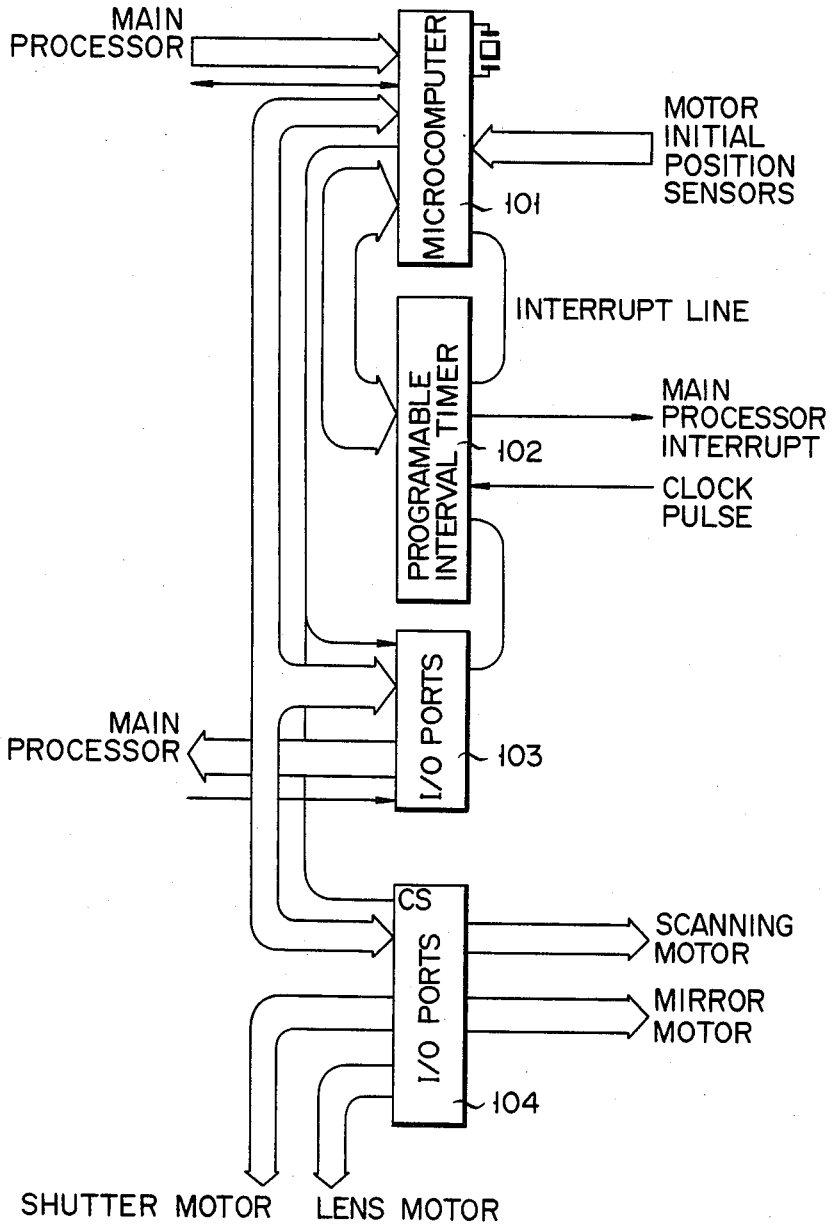

FIG. 9 shows an arrangement of the group 72. A microcomputer 101 is connected to the group 71. A programable interval timer 102 controls the switching interval of the pulse motor. A value is preset from the microcomputer 101 to the timer 102, and the timer starts counting the reference clock pulses. When the timer 102 count is completed, the timer 102 sends an end pulse onto an interrupt line of the microcomputer 101. The microcomputer 101 receives position data from the sensor 83 and is connected to I/O ports 103 and 104. The port 104 is connected to the motors 31 to 34 and 95 through the driver 79. The port 103 is used for supplying the status signals of the pulse motors to the group 71.

Figure 10:
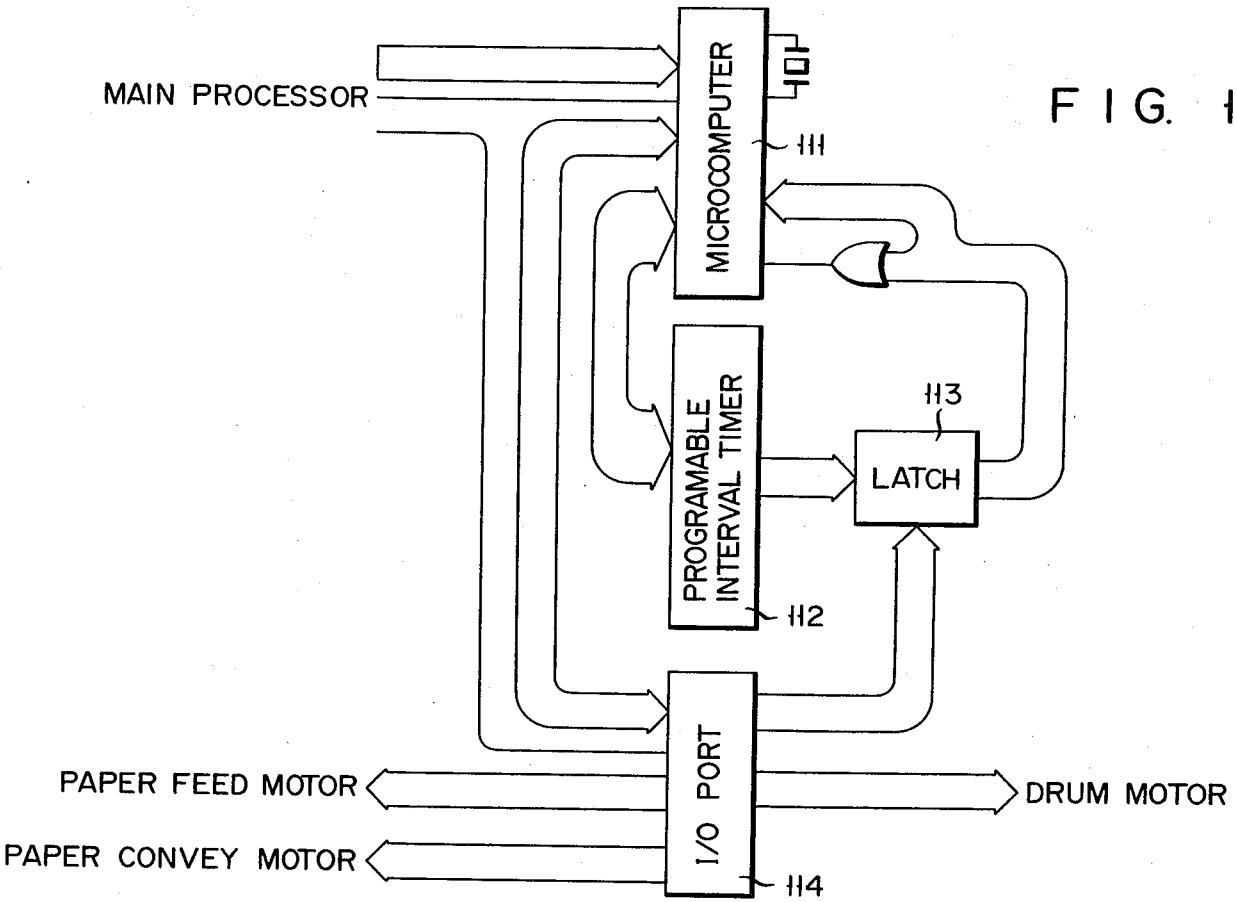

FIG. 10 shows an arrangement of the group 73. A microcomputer 111 is connected to the group 71. A programable interval timer 112 controls the switching interval of the pulse motor. When a value is preset from the microcomputer 111 to the timer 112, the timer 112 starts counting the reference clock pulses. When the timer 112 completes its count, an end pulse therefrom is latched by a latch 113. An output from the latch 113 is supplied to the interrupt line of the microcomputer 111 and the I/O port input line. The microcomputer 111 is also connected to an I/O port 114. The port 114 is connected to the motors 36, 38, 39 and 58 through the driver 80.

Figure 11:
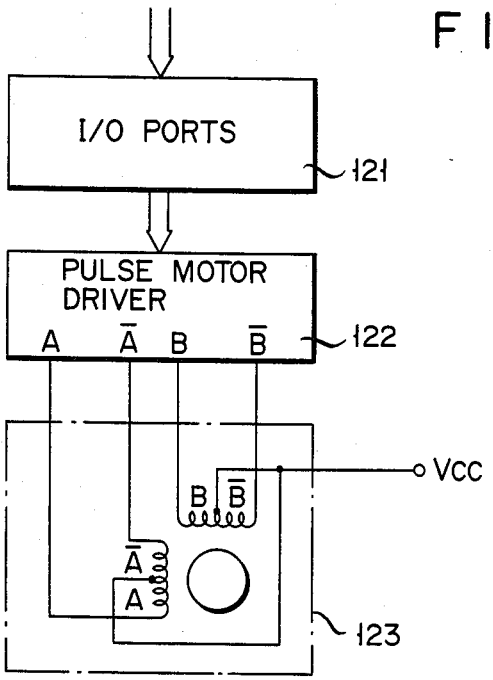

FIG. 11 shows a pulse motor control circuit. An I/O port 121 (corresponding to the ports 104 and 114 of FIGS. 9 and 10) is connected to a pulse motor driver 122 (corresponding to the drivers 79 and 80 of FIG. 7). The driver 122 is connected to windings $\overline{A}$, $\overline{B}$, A and B of a pulse motor 123 (corresponding to the pulse motors 31 to 34, 36, 38 and 39).

Figure 12:
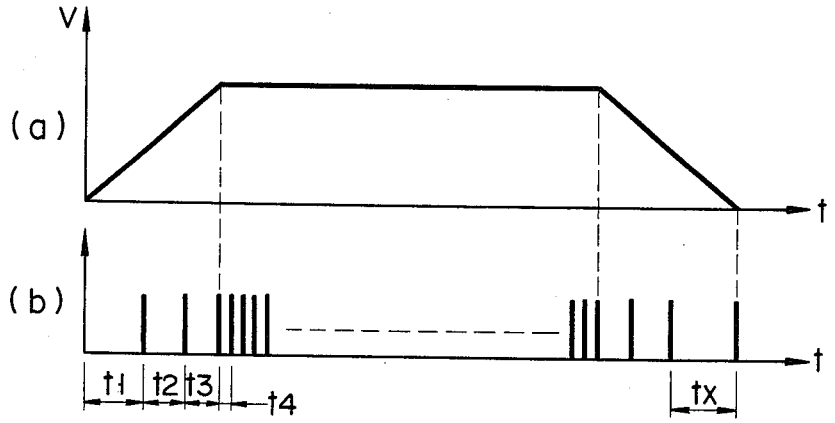

FIGS. 12(*a*) and 12(*b*) show a method of controlling the speed of the pulse motor. FIG. 12(*a*) shows the speed curve of the pulse motor, and FIG. 12(*b*) shows phase switching intervals. As is apparent from FIGS. 12(*a*) and 12(*b*), the switching intervals are long at the beginning, are gradually decreased, and are then finally equalized. Then, the intervals are prolonged, and the pulse motor is stopped. This sequence indicates the cycle-up and cycle-down of the pulse motor. The motor is started from the self-starting region, operated in a high-speed region and is gradually stopped. Reference symbols t1, t2, . . . tx denote times between the switching intervals.

Figure 13A:
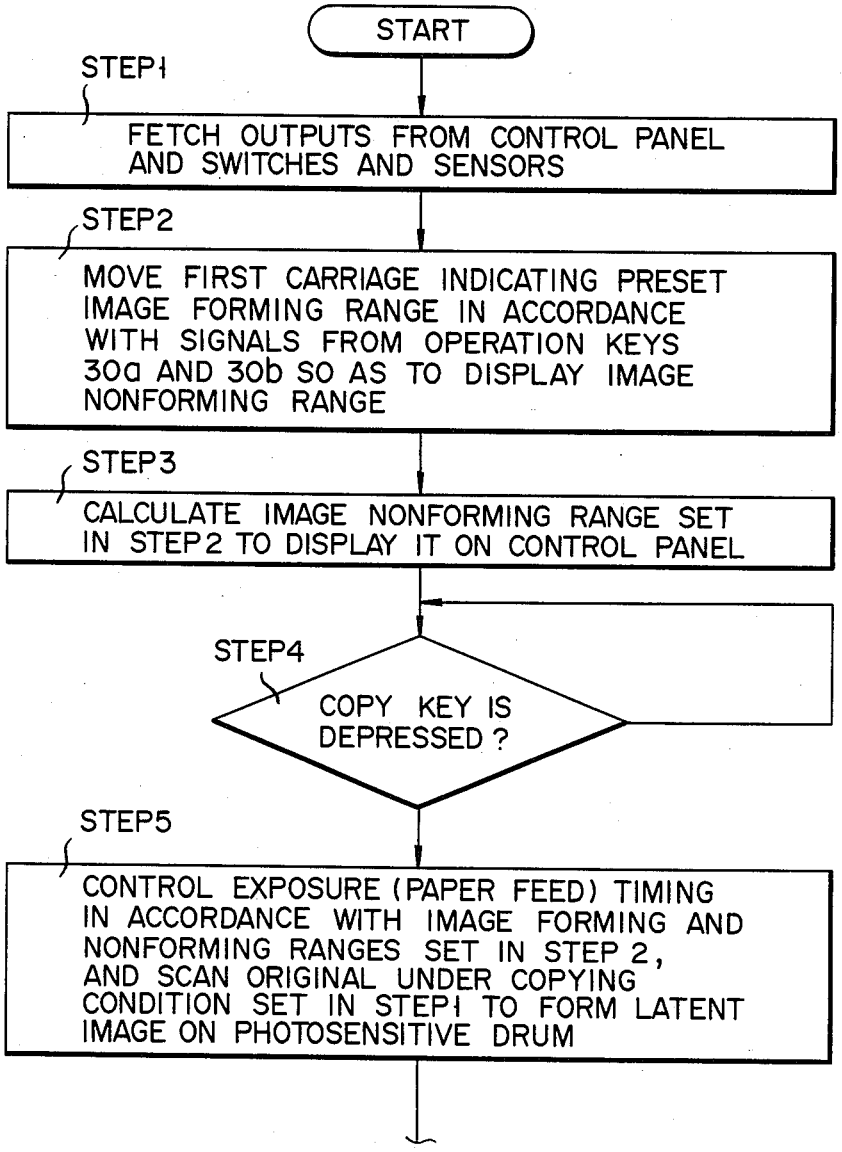
FIGS. 13A and 13B are flow charts explaining the operation of the main processor.
Figure 13B:
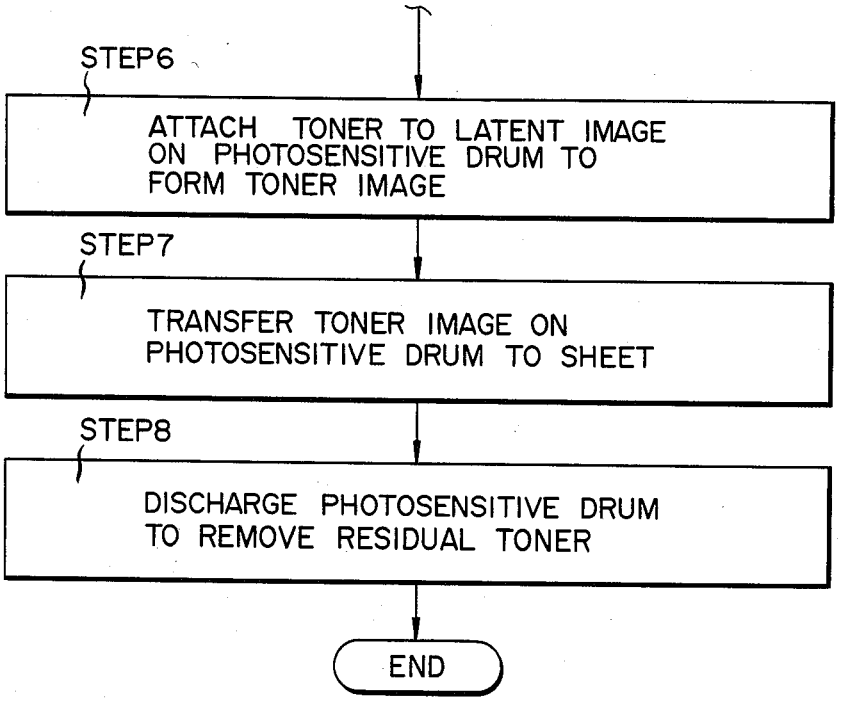

FIGS. 13A and 13B are flow charts explaining the operation of the one-chip microcomputer 91 in the main processor group 71.

In step 1, the microcomputer 91 fetches output from the control panel, the switches and the sensors.

In step 2, the first carriage indicating a preset image forming range is moved vertically so as to display an image nonforming range.

In step 3, the image nonforming range set in step 2 is calculated and displayed on the display unit of the control panel.

In step 4, it is checked if the copy start key is depressed.

In step 5, timing of the exposure lamp (paper feed) is controlled in accordance with the image forming and nonforming ranges so as to scan the original under the copying conditions set in step 1 and thereby form a latent image on the photosensitive drum.

In step 6, toner is attached to the latent image on the drum to form a toner image.

In step 7, the toner image on the drum is transferred to the sheet.

In step 8, the drum is discharged to remove residual toner.

An arrangement for displaying the image forming range of an original as a main feature of the present invention will be explained with reference to FIGS. 14 to 21. In this apparatus, the first carriage $41_1$ and the indexes 51 and 52 are driven in accordance with the preset magnification so to display the image forming range, and the first carriage $41_1$ is driven so as to display the image nonforming range utilized as, e.g., a binding margin at the left or right of the copied image. The position and width of the image nonforming range (to be referred to as a binding margin hereinafter) can be set by operating the operation key 30*a* or 30*b*. The preset width is displayed on both the display 30*c* and the table 2 by the movable scale 53 provided on the carriage $41_1$ and the stationary scale $2_1$ provided on the left side frame of the table 2. As indicated by the solid line in FIG. 14, the carriage $41_1$ is normally set in a standby state at a position corresponding to a preset copy enable range. In this state, when the key 30*a* is depressed the motor 33 is driven and the carriage $41_1$ is moved in the direction of the scale $2_1$. As indicated by the alternate long and a short dashed line in FIG. 14, when the carriage $41_1$ is located adjacent to the scale $2_1$, the keys 30*a* and 30*b* are appropriately operated, thereby setting the width $\delta$ of the desired binding margin. The width $\delta$ is defined by the mutual distance between the scales $2_1$ and 53. Therefore, an operator can confirm the binding margin on the table 2 in accordance with the state in which the original G is set thereon. Since the display 30*c* of the panel 30 quantitatively displays the width of the binding margin, the width can be quantitatively set with reference to the display 30*c*.

Figure 14:
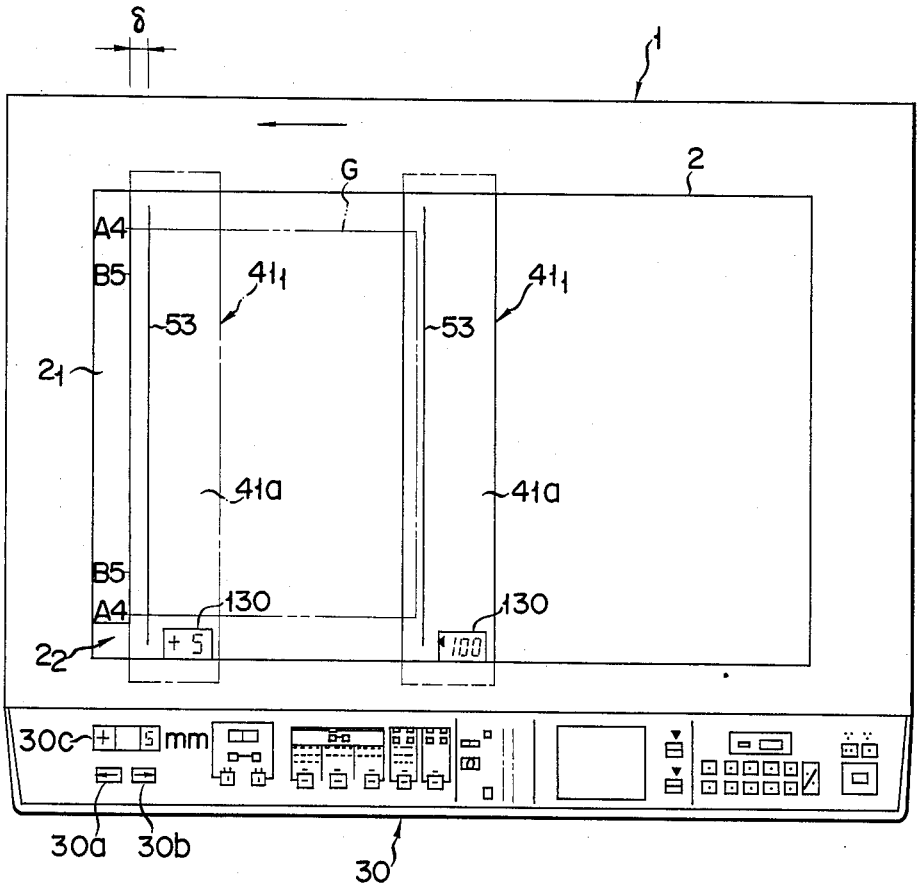
Figure 15:
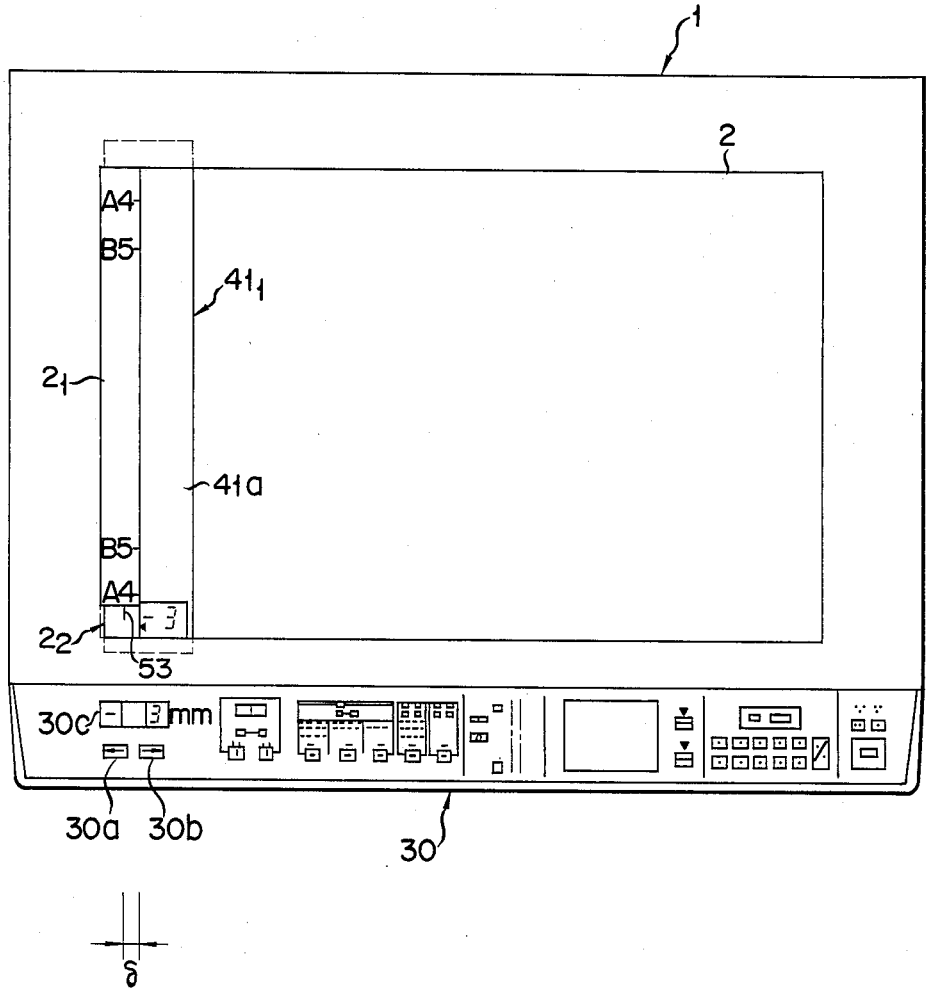

Display operation of the display 30*c* is performed, e.g., in such a manner that drive pulses of the motor 33 are counted so as to obtain the distance the carriage $41_1$ moves, with the width being calculated from the movement distance. Note that "+" and "−" indicate the forming position of the binding margin. When "+" is displayed, the binding margin is formed at the left of the copied image, and when "−" is displayed, at the right thereof. However, when the setting direction of the original is vertically reversed, the forming position of the binding margin is also reversed. FIG. 14 shows the position of the scale 53 when "+" is displayed, and FIG. 15 shows a position thereof when "−" is displayed. A boundary of "+" and "−" corresponds to an edge of the scale $2_1$.

Figure 16:
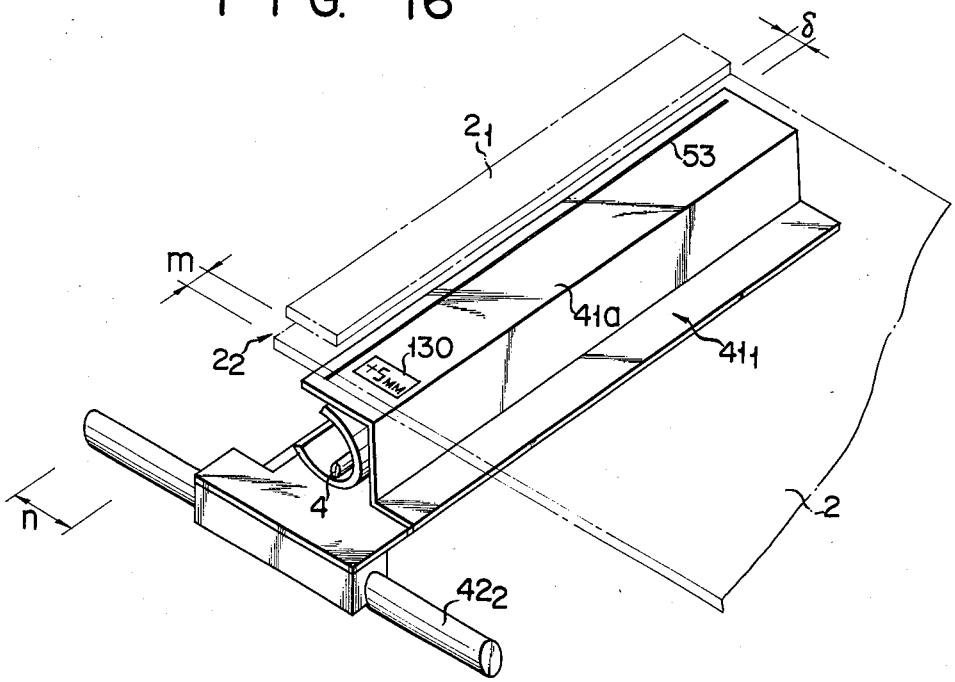

As shown in FIGS. 14 to 16, an m×n opening $2_2$ is provided at one end of the scale $2_1$ so that the transparent glass of the table 2 is partially exposed therethrough. Therefore, when the binding margin is set in the "−" direction, or when the binding margin is set to be $\delta=0$ mm, the scale 53 can be visually observed through the opening $2_2$, and the width of the binding margin can be easily checked.

Figure 17:
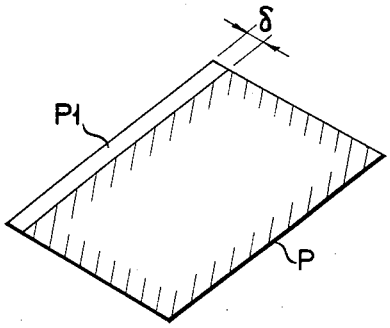

When the key $30_1$ is depressed after the width of the binding margin is set, an exposure timing of the lamp 4 or a paper feed timing of the sheet P is controlled in a known manner, and a binding margin $P_1$ is formed together with a desired image, as shown in FIG. 17.

Figure 18:
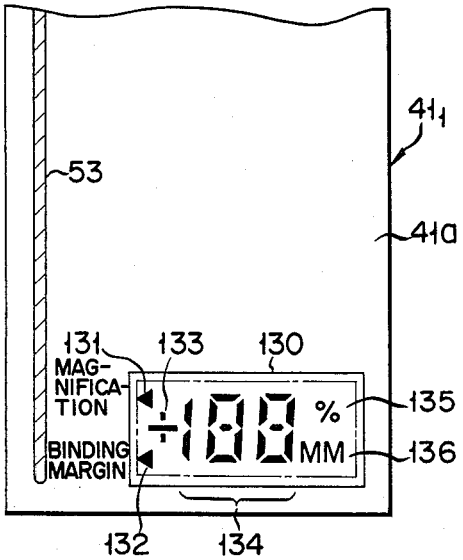

As shown in FIGS. 14 to 16, a display 130 is formed in a portion of a surface of a light shielding plate 41*a* of the carriage $41_1$ to be adjacent to the scale 53 and at a position substantially parallel to the opening $2_2$. The display 130 can selectively display a copying magnification and the binding margin, as shown in FIG. 18. FIG. 18 shows a state wherein all the segments of the display 130 are turned on, in which reference numeral 131 denotes a display indicating a copying magnification display; 132, a display indicating a binding margin display; 133, a display indicating the forming position of the binding margin; 134, a display indicating the copying magnification; 135 and 136, displays indicating units of the copying magnification and the binding margin.

A display signal supplied to the display 130 is the same as that supplied to the displays $30_8$ and $30_C$ of the control panel. The signal supplied to the display 134 indicating the preset value of the copying magnification or the binding margin and the display 133 indicating the forming position of the binding margin are the same as those supplied to the displays $30_8$ and $30_C$. The main processor group 71 selectively supplies a signal for driving the display 131 indicating the copying magnification, the display 132 indicating the binding margin and the displays 135 and 136 for displaying the preset values of the copying magnification and the binding margin.

Figure 19:
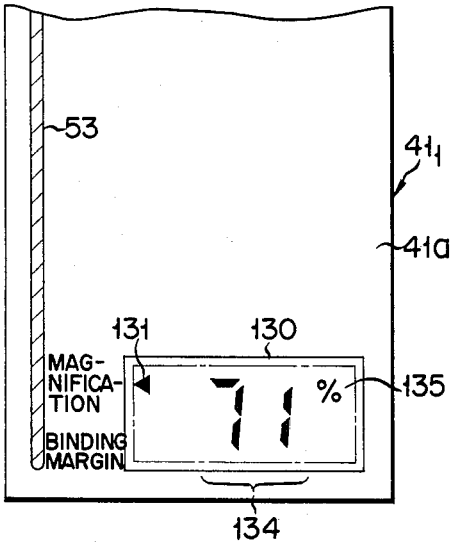
Figure 20:
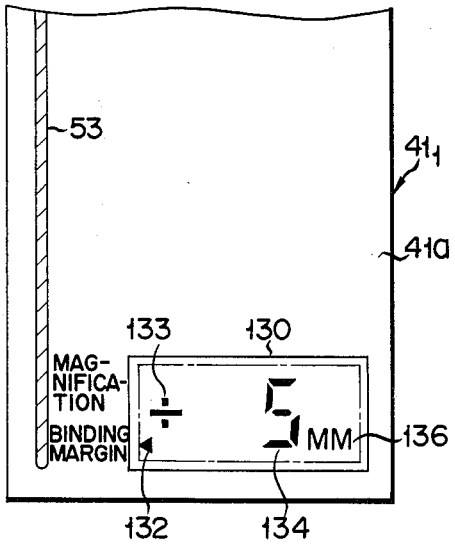

With this structure, since the first carriage $41_1$ is normally set in the standby state at a position indicating an image forming range corresponding to the copying magnification, the display 10 displays the copying magnification, as shown in FIG. 19. When the binding margin display mode is set in this state, a width of the binding margin corresponding to the preset value is displayed, as shown in FIG. 20. In this manner, the image forming range corresponding to the copying magnification and the image nonforming range used as the binding margin can be displayed in accordance with the position at which the first carriage $41_1$ is stopped. Therefore, since the image forming and nonforming ranges can be visually observed with reference to the original on the table 2, these ranges can be easily checked.

Since the image forming and nonforming ranges are displayed by utilizing the first carriage $41_1$, a special arrangement is not required, and an increase in the number of components is not necessary. Also since the image forming and nonforming ranges are quantitatively displayed on the display 130 which is provided on the first carriage $41_1$, an operator can check the preset value without checking the control panel 30 when he sets the original on the table 2, thereby resulting in excellent operability.

Figure 21:
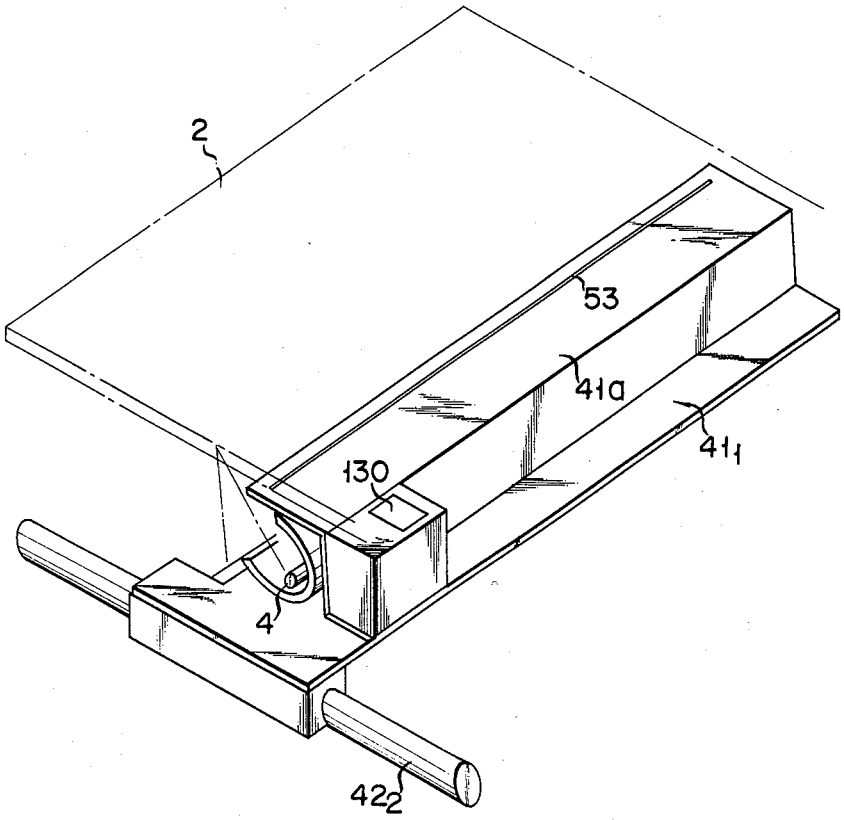

Note that the display 130 need not be provided on the light shielding plate 41*a* of the first carriage $41_1$, for it can be provided on the outer side surface of the first carriage $41_1$, as shown in FIG. 21. With this structure, the display 130 can be shielded from heat from the exposure lamp 4, and degradation in display 130 can be prevented. For the display 130, a liquid crystal panel or a light emitting diode having a segment structure can be used.

Furthermore, in the above embodiment, the image forming and nonforming ranges are displayed by the positions of the first carriage $41_1$ stationary scale $2_1$ and the indexes 51, 52. However, the image forming range can be displayed by the positions of the first carriage $41_1$ and the indexes 51, 52, and the second carriage $41_2$ can be independently driven so as to display the image nonforming range which is formed at the right or left of the image and utilized as the binding margin. In this case, a forming position and the width of the binding margin are set upon depression of the keys 30*a* and 30*b* of the control panel 30. The preset width is displayed on the display 30*c* and a movable scale 59 provided on the second carriage $41_2$ relative to the stationary scale $2_1$ provided on the table 2, as shown in FIGS. 22 and 23.

Figure 22:
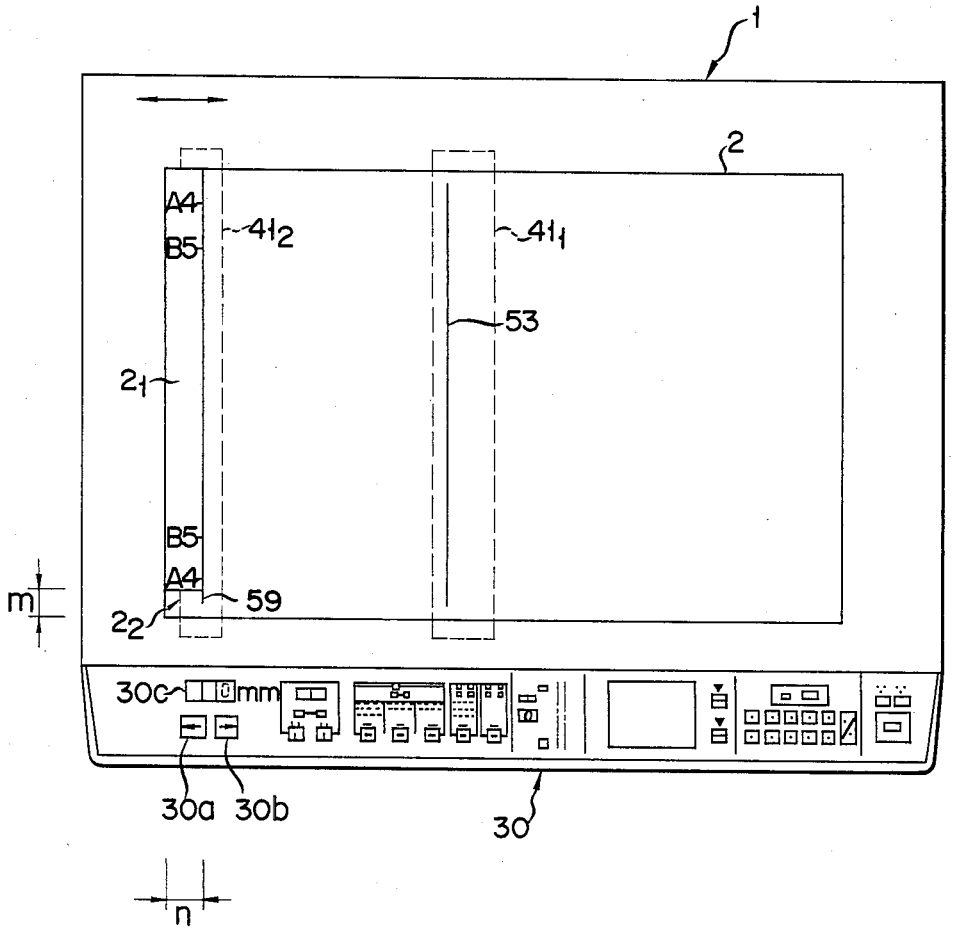
Figure 23:
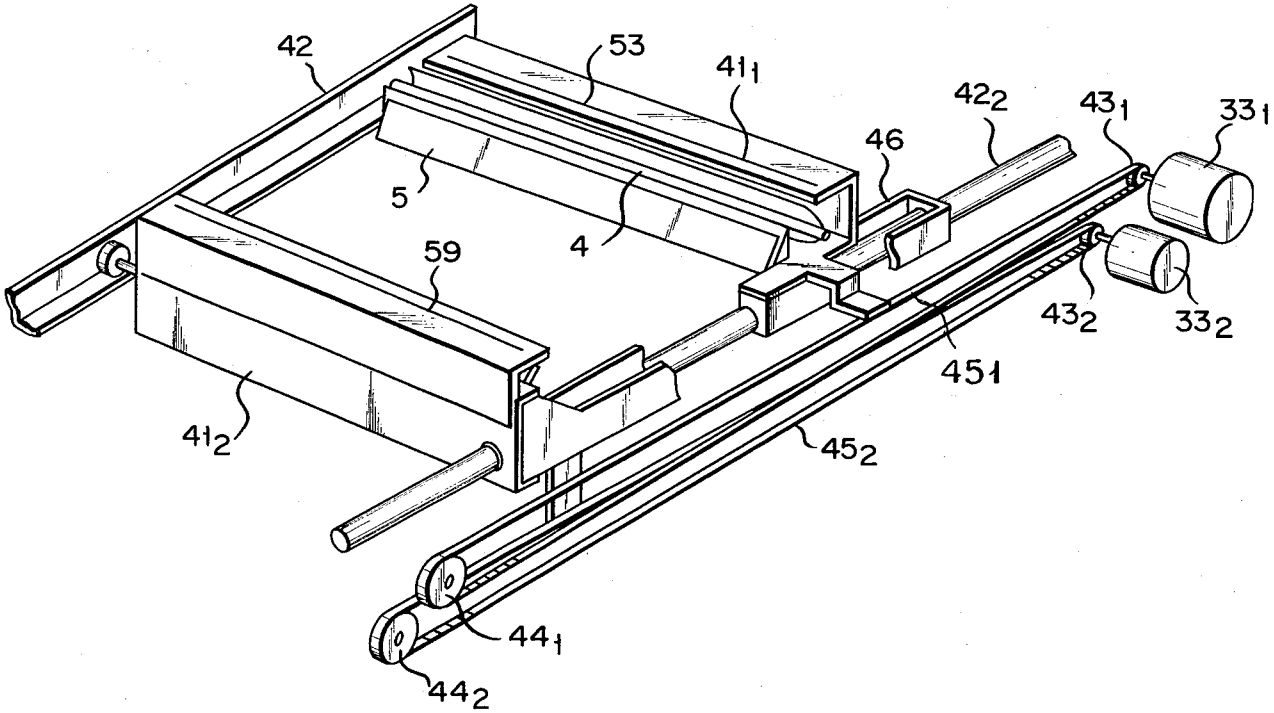
Figure 24:
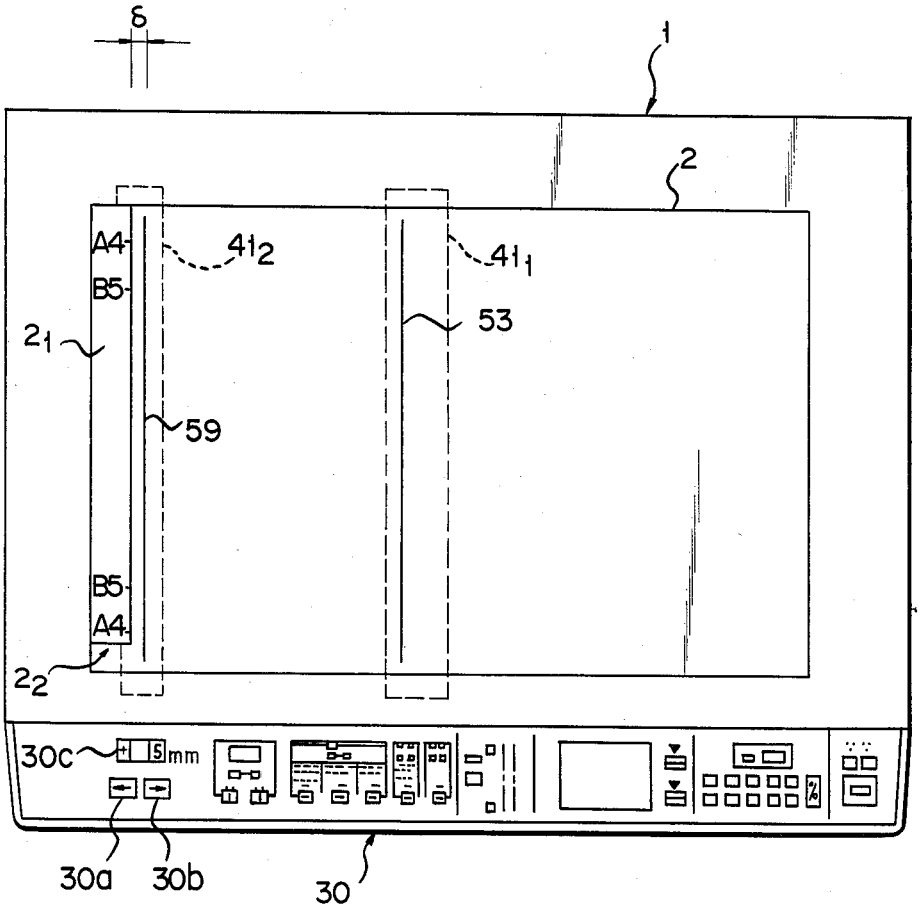
Figure 26:
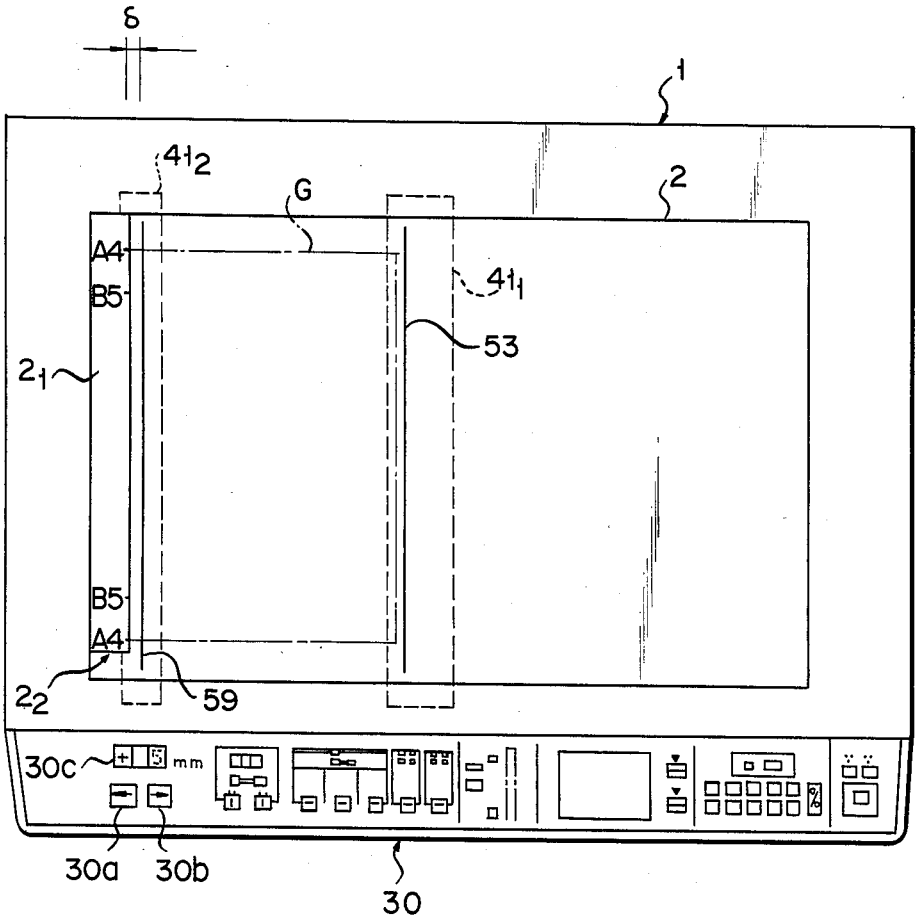

Therefore, as indicated by the dotted line in FIG. 22, when no binding margin is formed, i.e., when the preset value of the binding margin is 0 mm, the second carriage $41_2$ is set in the standby state at a position at which the scale 59 coincides with the edge of the scale $2_1$. In this state, when the keys 30*a* and 30*b* are properly operated, the second carriage $41_2$ is moved by a pulse motor $33_2$ in the direction indicated by an arrow in FIG. 22. FIGS. 24 26 show this state and indicate that the width $\delta$ of the binding margin is represented by the scales $2_1$ and 59.

Therefore, an operator can check the binding margin on the table 2 while setting the original G thereon. The width also can be quantitatively set with reference to the display 30*c* of the panel 30. Since the distance the second carriage $41_2$ moves is obtained by counting drive pulses of the pulse motor $33_2$, the width is calculated from the count so as to be displayed. "+" or "−" on the display 30*c* indicates the forming position of the binding margin. As shown in FIG. 24, when "+" is displayed, the binding margin is formed at the left of the image, and when "−" is displayed, it is formed at the right of the image. Note that when the setting position of the original is reversed, the forming position of the binding margin is also reversed.

Figure 25:
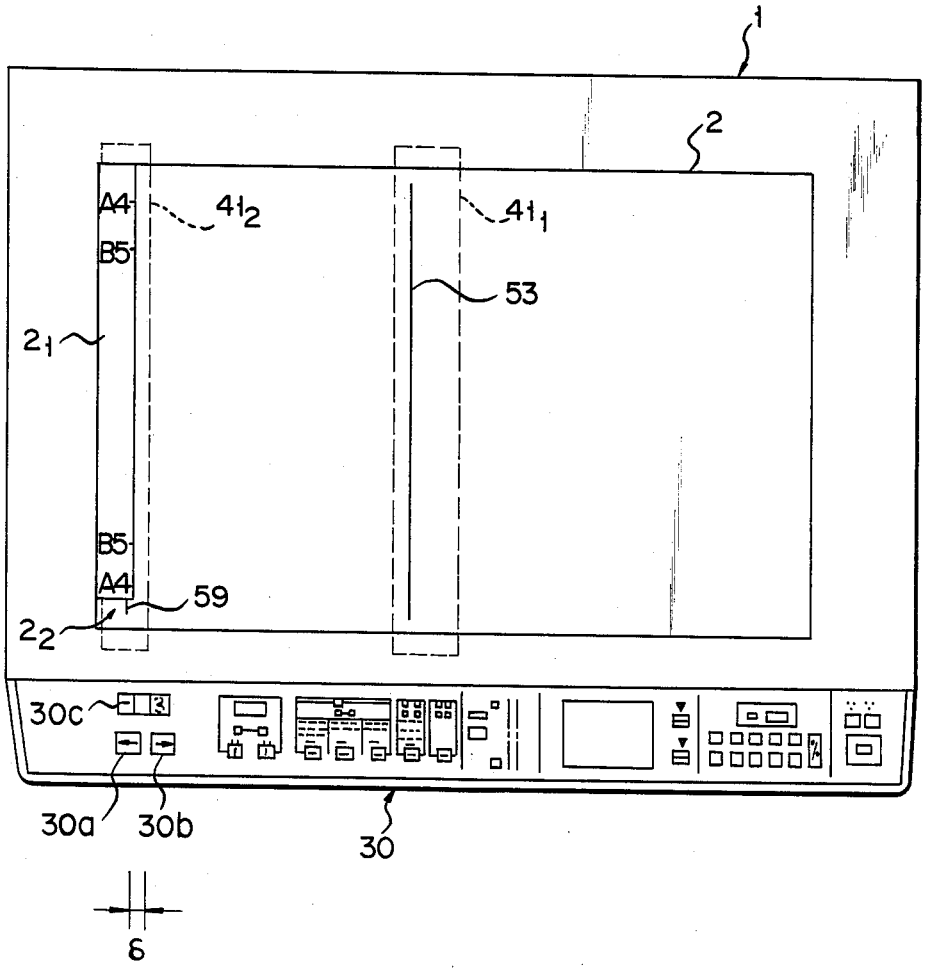

As shown in FIGS. 22, 24 and 25, the m×n opening $2_2$ is provided so as to expose a transparent glass therethrough. Therefore, when the binding margin is set in the "−" direction or when the binding margin is set to be $\delta=0$ mm, the movable scale 53, 59 can be visually observed through the opening $2_2$, and the width of the binding margin can be easily checked.

Figure 27:
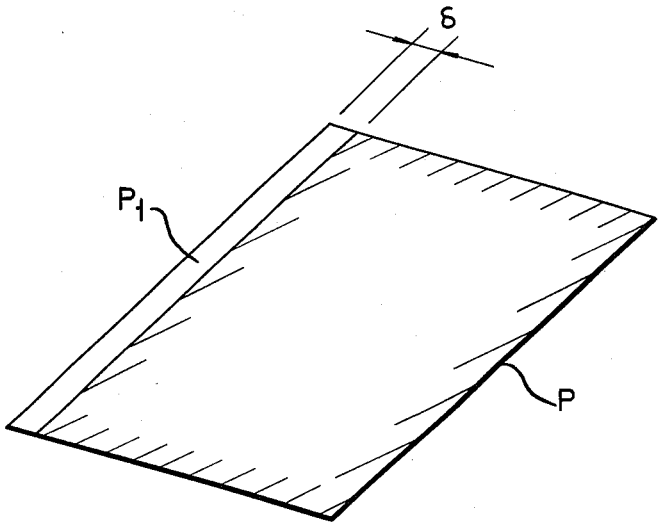

When the copy key $30_1$ is depressed after setting the width of the binding margin, the second carriage $41_2$ is moved to the left of the stationary scale $2_1$, and the first carriage $41_2$ is moved in the direction toward the stationary scale $2_1$. Thereafter, the second carriage $41_2$ follows the first carriage $41_1$ at a speed ½ that of the first carriage $41_1$. Then, as described above, the exposure timing of the lamp 4 or the paper feed timing of the sheet P is controlled based upon the preset value in a known manner, and, as shown in FIG. 27, the binding margin $P_1$ is formed on the sheet P together with the desired image. Note that FIG. 27 shows the state where the binding margin is set in the "+" direction, as shown in FIG. 24.

The first and second carriages $41_1$, $41_2$ are independently driven, and the image forming range is indicated by the first carriage $41_1$, whereas the image nonforming range is indicated by the second carriage $41_2$. Therefore, these ranges can be easily checked on the table 2. Since the image forming and nonforming ranges are indicated by using the scale 53, 59 provided on the first and second carriages $41_1$, $41_2$, a special mechanism is not required, and only a slight increase in the number of components is necessary. In the above embodiment, the indexes 51 and 52 are provided on the second carriage $41_2$, but the present invention is not limited to this. They can be provided at, e.g., the rear side of the stationary scale $2_1$.

Figure 28:
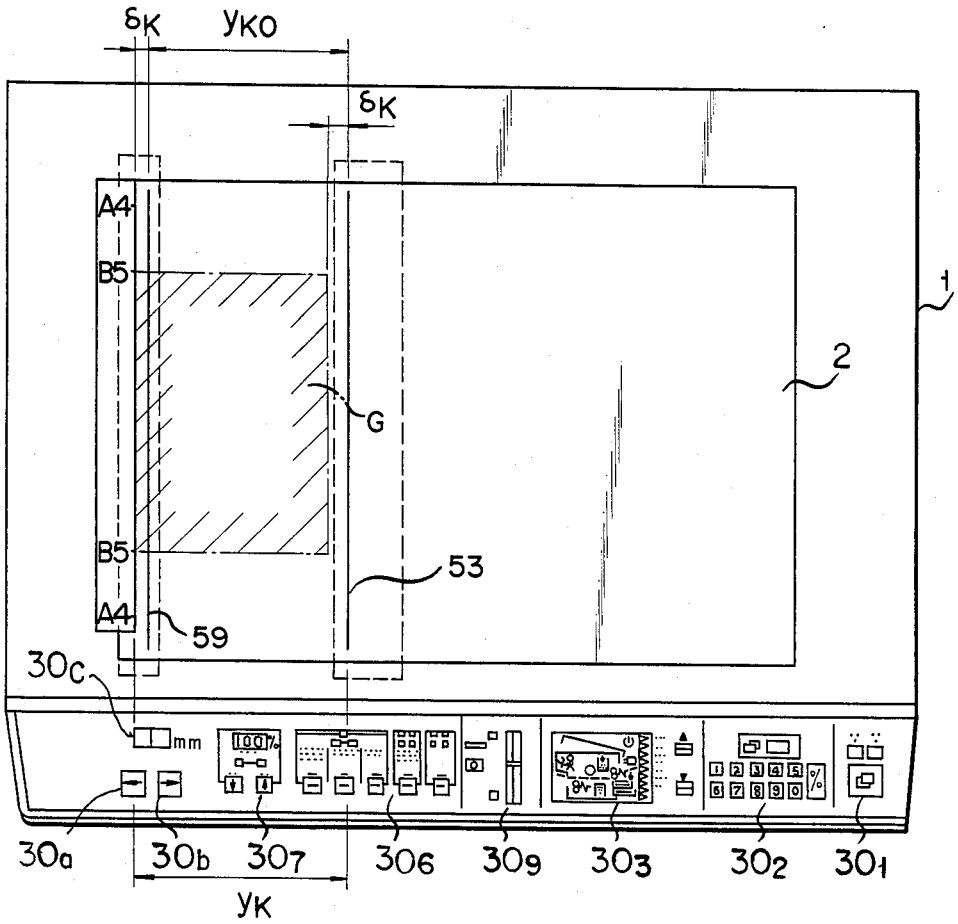
FIG. 28 is a plan view illustrating how the copying magnification is varied in accordance with still another embodiment of an image forming apparatus in accordance with the present invention.

When the copying magnification is to be changed, e.g., when a B4-size original G is to be copied to an A4-size paper P in an enlargement mode, the copying magnification is 116% (K=1.16). In this case, although the width $\delta_P$ of the binding margin is displayed after the copying operation, the scale 59 provided on the second carriage $41_2$ is set at a position $\delta_K=\delta_P/K$ as shown in FIG. 28. Then, since $y_{KO}=y_P/K$ with respect to the width $y_P$ of the paper P, the scale 53 of the first carriage $41_1$ is set at a position of $y_K=y_{KO}+\delta_K=(y_P+\delta_P)/K$. That is, the region existing between the first and second carriages $41_1$, $41_2$ represents the actual copying range. Since the first carriage $41_1$ indicates a copying area in the y direction and the second carriage $41_2$ indicates the binding margin, the copying area and the binding margin can be simultaneously displayed.

What is claimed is:

1. An image forming apparatus comprising:

a photosensitive body for holding an electric charge on a surface thereof;

charging means for supplying the electric charge to said photosensitive body;

a transparent original table for supporting an original on an upper surface thereof;

scanning means provided along a lower surface of the original table for optically scanning an image of the original;

image exposure means for exposing, with light guided by said scanning means, a designated portion of said photosensitive body to which the electric charge is supplied from said charging means so as to form an electric charge pattern in accordance with the image of the original;

developing means for developing the electric charge pattern formed on said photosensitive body by said image exposure means;

means for transferring and fixing an image developed by said developing means to a transfer medium;

display means provided on said scanning means for selectively displaying a copying magnification and a width of a binding margin; and means for causing said display means to selectively display one of the copying magnification and the width of the binding margin according to a position of the scanning means with respect to the original table.

2. An apparatus according to claim 1, wherein said scanning means indicates a preset image forming range and is moved to one end of the binding margin, thereby indicating the image nonforming range.

3. An apparatus according to claim 1, wherein said scanning means is stopped at a position of $y=P_y/K$ so as to display the binding margin, where a moving distance of said scanning means is given by $P_y$ and a magnification of an image is given by K.

4. An apparatus according to claim 1, wherein said display means is a liquid crystal panel.

5. An apparatus according to claim 1, wherein said display means is a light-emitting element having a segmented structure.

6. An apparatus according to claim 1, further comprising optical path length means for following said scanning means so as to set an optical path length, an image forming range being displayed by said scanning means, and the binding margin being displayed by said optical path length means.

7. An apparatus according to claim 6, wherein said scanning means and said optical path length means are driven by a pulse motor.

8. An apparatus according to claim 6, wherein said optical path length means is moved at a speed ½ that of said scanning means so as to scan the original.

9. An image forming apparatus comprising:

a photosensitive body for holding an electric charge on a surface thereof;

charging means for supplying the electric charge to said photosensitive body;

scanning means for optically scanning an image of an original, the scanning means indicating a preset image forming range and being moved to one end of a binding margin so as to indicate the binding margin;

image exposure means for exposing, with light guided by said scanning means, a designated portion of said photosensitive body to which the electric charge is supplied from said charging means so as to form an electric charge pattern in accordance with the image of the original;

developing means for developing the electric charge pattern formed on said photosensitive body by said image exposure means;

means for transferring and fixing an image developed by said developing means to a transfer medium;

binding margin display means for setting an image nonforming range upon operation of said scanning means on the surface of an original table prior to a copying operation so as to display the binding margin; and means for preventing formation of an image with a range displayed by said binding margin display means.

10. An apparatus according to claim 9, wherein said scanning means is stopped at a position of $y=Py/K$ so as to display the binding margin, where the moving distance of said scanning means is given by Py and a magnification of an image is given by K.

11. An apparatus according to claim 9, wherein said display means is a liquid crystal panel.

12. An apparatus according to claim 9, wherein said display means is a light-emitting element having a segmented structure.

13. An image forming apparatus comprising:

a photosensitive body for holding an electric charge on a surface thereof;

charging means for supplying the electric charge to said photosensitive body;

scanning means for optically scanning an image of an original;

image exposure means for exposing, with light guided by said scanning means, a designated portion of said photosensitive body to which the electric charge is supplied from said charging means so as to form an electric charge pattern in accordance with the image of the original;

developing means for developing the electric charge pattern formed on said photosensitive body by said image exposure means;

means for transferring and fixing an image developed by said developing means to a transfer medium;

image nonforming range display means for setting an image binding margin upon operation of said scanning means on the surface of an original table prior to a copying operation so as to display the binding margin;

means for preventing formation of an image within a range displayed by said binding margin display means; and optical path length means for following said scanning means so as to set an optical path length, an image forming range being displayed by said scanning means, and the binding margin being displayed by said optical path length means.

14. An apparatus according to claim 13, wherein said scanning means and said optical path length means are driven by a pulse motor.

15. An apparatus according to claim 13, wherein said optical path length means is moved at a speed $\frac{1}{2}$ that of said scanning means so as to scan the original.

* * * * *